US005384511A

United States Patent [19]

Fujimura

[11] Patent Number: 5,384,511

[45] Date of Patent: Jan. 24, 1995

[54] VARIBLE-THICKNESS SHADOW MASK FOR COLOR CATHODE-RAY TUBES

[75] Inventor: Takeo Fujimura, Nagaokakyo, Japan

[73] Assignee: Mitsubishi Denki Kabushiki Kaisha, Tokyo, Japan

[21] Appl. No.: 203,754

[22] Filed: Mar. 1, 1994

Related U.S. Application Data

[63] Continuation of Ser. No. 946,673, Sep. 18, 1992, abandoned.

[30] Foreign Application Priority Data

Sep. 19, 1991 [JP] Japan ..... 3-239056

[51] Int. Cl.[6] ..... H01J 29/07

[52] U.S. Cl. ..... 313/402; 313/403

[58] Field of Search ..... 315/402, 403, 404, 405, 315/406, 407, 408

[56] References Cited

U.S. PATENT DOCUMENTS 3,872,345 3/1975 Yamazaki et al. ..... 313/402
4,072,876 2/1978 Morrell .
4,122,368 10/1978 Masterton .
4,146,816 3/1979 Morrell .
4,173,729 11/1979 Stone et al. .
4,187,443 2/1980 D'Amato et al. .
4,195,248 3/1980 D'Amato et al. .
4,727,280 2/1988 Fujimura .

FOREIGN PATENT DOCUMENTS 50-40980 12/1975 Japan .
55-76553 6/1980 Japan .

OTHER PUBLICATIONS

"A Theoretical Study of Doming Phenomena in Shadow-Mask Tubes", The Journal of the Institute of Television Engineering, vol. 31, No. 6, p. 47, Jun. 1977.

*Primary Examiner*—Donald J. Yusko
*Assistant Examiner*—N. D. Patel

[57] ABSTRACT

An apertured shadow mask is curved so that the curvature is concave on the back surface. The front surface generally follows the curvature of the back surface but has an undulating profile with ribs separated by troughs. The local thickness of the shadow mask is greatest in the ribs, and becomes gradually thinner toward the center lines of the troughs. The ribs and the center lines of the troughs have a zig-zag configuration. As a result, the front surface and neutral plane of the shadow mask have both convex and concave areas, which reduces localized doming.

35 Claims, 5 Drawing Sheets

VARIBLE-THICKNESS SHADOW MASK FOR COLOR CATHODE-RAY TUBES

This application is a continuation of application Ser. No. 07/946,673 filed on Sep. 18, 1992, now abandoned.

BACKGROUND OF THE INVENTION

This invention relates to a shadow mask for a color cathode-ray tube, more particularly to a curved shadow mask with thickness variations adapted to prevent localized doming.

Electron beams impinging on a shadow mask cause it to heat and expand. When the heating is localized it can cause part of the shadow mask to bulge outward, a phenomenon known as localized doming, the visible result of which is color misregistration in a local area on the screen. This problem is particularly noticeable in cathode-ray tubes with wide deflection angles. It is a major concern in the design of recent television sets with 110° deflection angles and relatively flat screens. A variety of measures have been taken to prevent or reduce localized doming, but none have been satisfactory.

Instead of being made of steel, for example, a shadow mask can be made of Invar, a nickel-steel alloy with a low coefficient of thermal expansion. Unfortunately, use of Invar increases the material cost and the cost of the manufacturing process while reducing the manufacturing yield. The anti-doming effect is moreover not as great as hoped for, because while Invar has only 1/9 the coefficient of thermal expansion of steel, it also has only 1/5 the thermal conductivity. Thus, heat cannot easily escape from localized areas. In practice, the use of Invar reduces doming by only about seventy percent, which is inadequate.

Another possible countermeasure is to coat the back surface of the shadow mask with a heavy metal oxide such as lead oxide or bismuth oxide. The heavy metal atoms tend to reflect electrons, thereby reducing heating of the shadow mask. Coating a steel shadow mask with such an oxide, however, reduces doming by only about thirty percent, which is far from adequate. Further, the manufacturing process becomes more difficult and costly because the oxide has an unwelcome tendency to clog apertures in the shadow mask.

Corrugation, which has been used to give rigidity to flat shadow masks, is also useful in preventing doming. A corrugated shadow mask is bent in a repeating wave-like or step-like pattern that interferes with the formation of localized domes. Since a corrugated shadow mask necessarily departs from the ideal mask geometry, however, there is an unavoidable loss of picture quality.

Formation of grooves that reduce the rigidity of the shadow mask in the direction of greatest curvature has also been proposed. However, this measure has turned out to be effective only under certain restricted conditions, and does not appear to be practical in general.

SUMMARY OF THE INVENTION

It is accordingly an object of the present invention to reduce localized doming in shadow masks.

Another object of the invention is to prevent color misregistration.

The invented shadow mask comprises a metal sheet with apertures for the passage of electron beams. The back surface of the metal sheet has a concave curvature. The front surface generally follows the curvature of the back surface but has an undulating profile with ribs separated by troughs. The local thickness of the metal sheet is greatest in the ribs, gradually thinning toward the center lines of the troughs. The ribs and center lines of the troughs have a zig-zag configuration.

The invented shadow mask is manufactured by first etching the metal sheet to create the apertures, then press-forming the metal sheet to impart the necessary curvature. Next the metal sheet is placed on a supporting block with identical curvature, and its front surface is machined to create the local thickness variations.

DETAILED DESCRIPTION OF THE INVENTION

Embodiments of the invention will be described with reference to the attached drawings. These drawings illustrate the invention but do not restrict its scope, which should be determined solely from the appended claims.

Figure 1A:
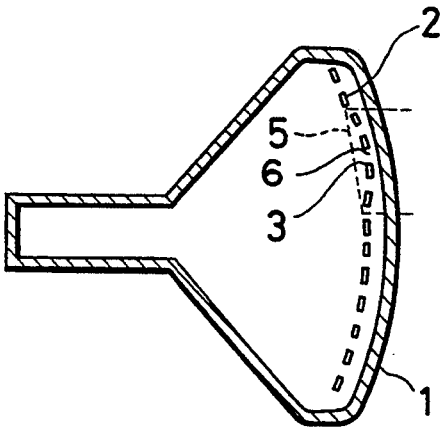
FIG. 1A and FIG. 1B show side and frontal views of a cathode-ray tube and illustrates localized doming.
Figure 1B:
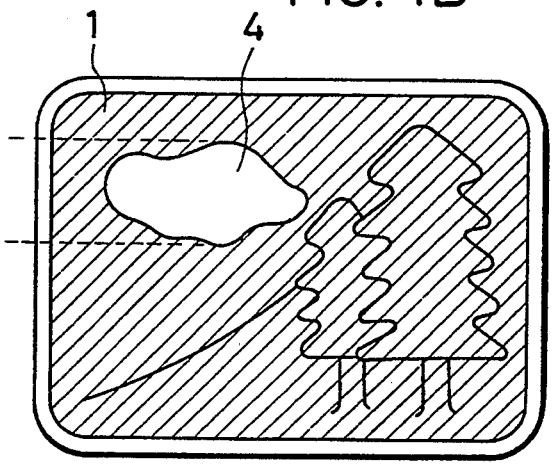

First, to illustrate the general problem of localized doming, FIG. 1 shows side and frontal views of a color cathode-ray tube with a conventional shadow mask. The tube comprises a faceplate 1 behind which is disposed a shadow mask 2 with apertures 3 for the passage of electron beams generated by electron guns. Electrons excite phosphors coated on the inside surface of the faceplate 1 to create a color image. The electron beams, electron guns, and phosphors are omitted to avoid cluttering the drawing with unnecessary detail.

If the image has a stationary bright area such as a white cloud 4 surrounded by a darker area such as a blue sky, the electron beams heat the part of the shadow mask 2 corresponding to the cloud 4 more intensely than they heat the surrounding parts. This part therefore expands and bulges from its normal position 5 to form a localized dome 6. The curvature of the dome 6 is in the same direction as the general curvature of the shadow mask 2, in this case toward the faceplate 1.

Figure 2:
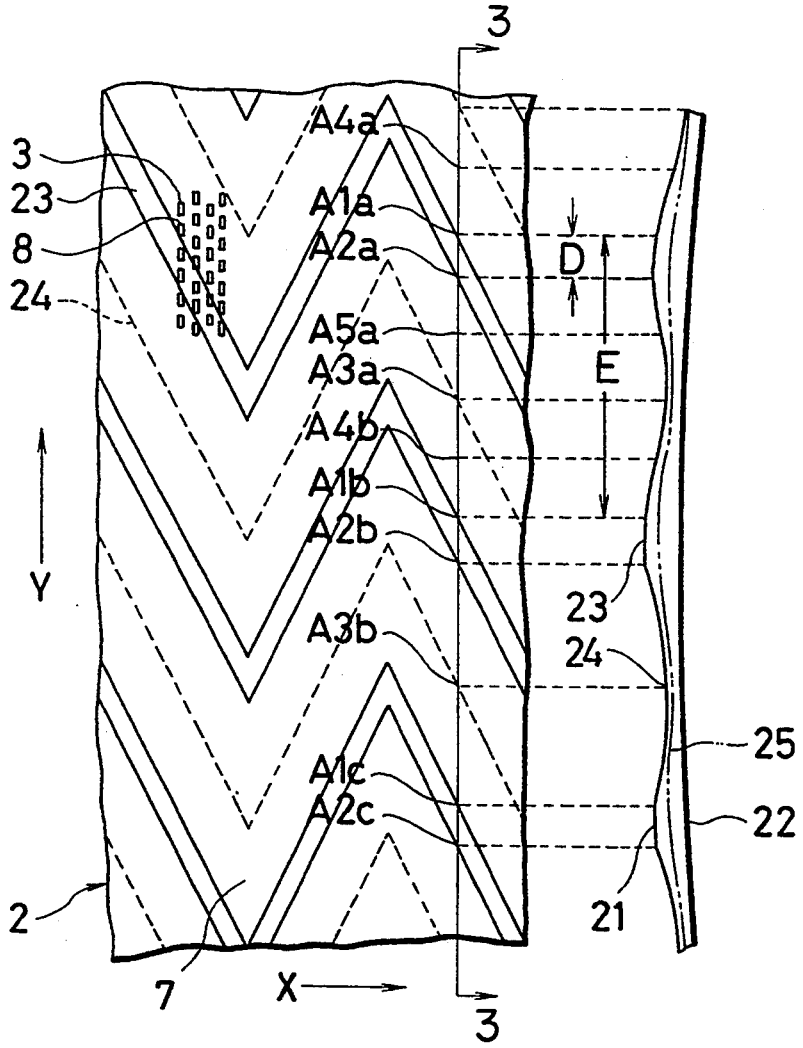
FIG. 2 shows a plan view and sectional view of a novel shadow mask with slot apertures.

Next, FIG. 2 illustrates a first novel shadow mask, showing both a plan view of part of the shadow mask and a cross section through the line 3—3. The shadow mask 2 is made from a steel sheet 7 that is, for example, 0.25 mm thick. For clarity, apertures 3 are shown on only part of the shadow mask 2. The apertures 3 are aligned in columns in the vertical direction of the shadow mask 2, separated in this direction by bridges 8. The vertical direction will be referred to as the Y direction and the horizontal direction as the X direction.

As can be seen in the sectional view, the front surface 21 and back surface 22 are both curved. The curvature conforms, for example, to the contour of the faceplate (not shown in FIG. 2). The back surface 22 is uniformly concave. The front surface 21 generally follows the curvature of the back surface 22, but has an undulating profile. The shadow mask 2 accordingly varies in thickness. The thickest parts form zig-zag ribs 23; these are separated by troughs with zig-zag center lines 24. The zig-zag ribs 23 parallel one another and run generally in the X direction, as seen in the plan view, the letters D and E representing the distances of 2 mm and 15 mm, respectively.

Between the front surface 21 and back surface 22 there exists a neutral plane 25 which is not strained by bending. Because of the undulating profile of the front surface 21, this neutral plane 25 also undulates, as shown, so that it curves in one direction near the ribs 23 and in the opposite direction near the center lines 24 of troughs.

Figure 3:
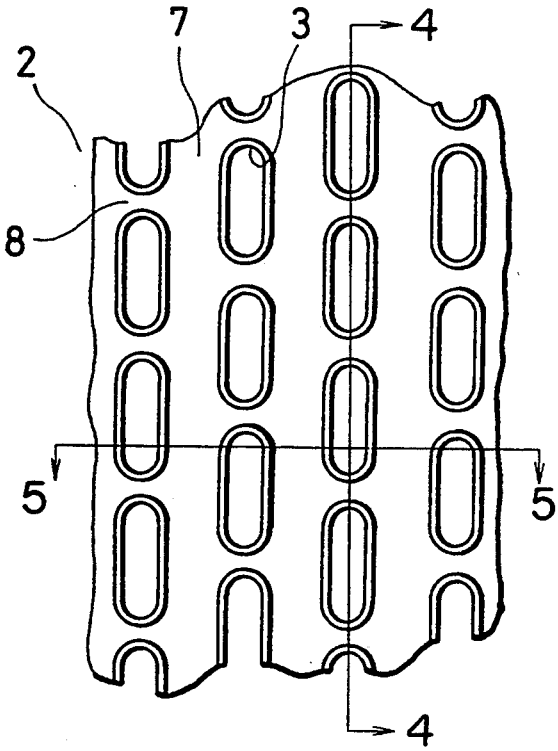
FIG. 3 is an enlarged view of part of the shadow mask in FIG. 2.

Referring to FIG. 3, the apertures 3 have the form of elongated slots measuring 0.75 mm in the Y direction (along the line 4—4) and 0.20 mm in the X-direction (along the line 5—5). Apertures 3 are disposed at intervals of 0.90 mm in the Y direction. Columns of apertures 3 are disposed at intervals of 0.72 mm in the X direction. The apertures 3 are formed by etching the steel sheet 7. FIG. 3 shows the state after etching but before further processes that give the shadow mask 2 its overall curvature and undulating thickness profile.

Figure 4:
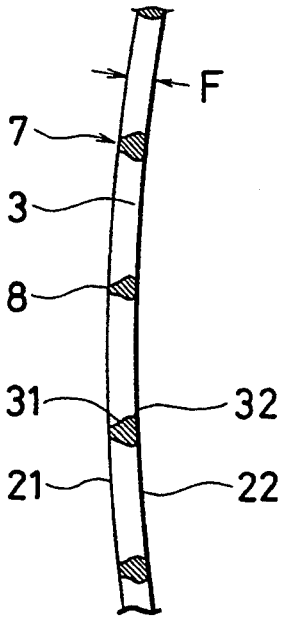
FIG. 4 is an enlarged vertical sectional view of the shadow mask in FIG. 2.

FIG. 4 is a sectional view of the shadow mask 2 in the Y direction, showing a later state in which the shadow mask 2 has been given its overall curvature, but thickness variations have not been created. The apertures 3 have sidewalls that taper outward toward both the front surface 21 and back surface 22. The front taper 31 is deeper than the back taper 32, the letter F representing a distance of 0.25 mm.

Figure 5:
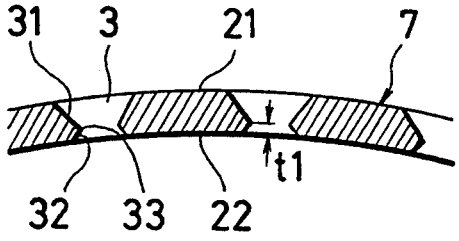
FIG. 5 is an enlarged horizontal sectional view of the shadow mask in FIG. 2.

FIG. 5 shows a sectional view in the X direction, illustrating the same front taper 31 and back taper 32 of the apertures 3. Passage of electron beams through the shadow mask 2 is controlled by the minimum dimensions of the apertures 3, which occur at a minimum aperture plane 33 where the front taper 31 meets the back taper 32. The distance $t_1$ of this minimum aperture plane 33 from the back surface 22 is much smaller than the thickness of the steel sheet 7 from which the shadow mask 2 is made. For example, where the steel sheet 7 is 0.25 mm thick, the distance $t_1$ is only 0.03 mm.

The overall radius of curvature of the shadow mask 2 is, for example, 2500 mm in both the X and Y directions. The radius of curvature is calculated so that the apertures 3 are disposed in desired positions in relation to the phosphor coating on the faceplate. The positions are calculated with respect to the minimum aperture plane 33 in FIG. 5.

Before the undulating profile of time shadow mask 2 is described in more detail, it will be useful to introduce the term "local thickness." Local thickness designates the thickness of the shadow mask 2 as if the apertures 3 and their front and back tapers 31 and 32 were not present. For example, the local thickness of the shadow mask 2 in FIG. 3 is defined to be 0.25 mm at all points, despite the existence of the apertures 3.

Referring again to FIG. 2, in the Y direction the profile of the front surface 21 has a repeating pattern with a repeating length of 15 mm. For example, the interval from point A1*a* to point A1*b* is 15 mm (represented by the letter E). The same pattern is repeated throughout the entire section through line 3—3, and in all sections parallel to line 3—3. The ribs 23 are 2 mm wide and retain the original local thickness of the steel sheet 7. That is, the distance between points A1*a* and A2*a* is 2 mm (represented by the letter D) and the local thickness in this interval is 0.25 mm. The same applies to the intervals from A1*b* to A2*b*, A1*c* to A2*c*, etc. In the interval from A2*a* to A1*b*, referred to as a trough, the local thickness diminishes gradually, reaching a minimum value of 0.10 mm at point A3*a* on the center line 24 of the trough. The local thickness likewise diminishes in the interval from A2*b* to A1*c*, and in other troughs.

Referring again to the plan view in FIG. 2, the full amplitude of the zig-zag of the ribs 23 in the Y direction is 15 mm, the same as the spacing between the ribs 23 in the Y direction. The repeating length of the zig-zag in the X direction is also 15 mm. The center lines 24 of the troughs between the ribs 23 have the same zig-zag shape with the same repeating length and spacing of 15 mm in the X and Y directions.

Next the effect of the invention in reducing localized doming will be described.

The neutral plane 25 in FIG. 2 can be defined as follows. If a strip (with a width that is several times larger than the interval between the apertures 3 in the X direction but preferably less than 1/100 of the radius of curvature of the back surface 22) is cut from the shadow mask 2 parallel to the line A—A arid bent in a direction perpendicular to the plane of the strip, with a bending radius sufficiently greater than the thickness of the strip, the neutral plane 25 is the plane at which neither tension nor compression occurs. Since the shadow mask 2 is a thin plate, mechanical theory indicates that the neutral plane 25 is located substantially midway through the local thickness of the shadow mask 2.

In the interval between the points A4*a* and A5*a*, the neutral plane 25 curves outward toward the front surface 21, because the shadow mask 2 as a whole is curved in this direction and the curvature is increased by the convex profile of the front surface 21 in this interval. In the interval between the points A5*a* and A4*b*, although the overall curvature of the shadow mask 2 is still unchanged, the concave profile of the front surface 21 in this interval imparts an opposite curvature to the neutral plane 25, the net effect being that the neutral plane 25 curves away from the front surface 21.

When the shadow mask 2 is locally heated, it bulges in the direction in which its neutral plane 25 is already curved. Accordingly, if localized doming occurs in FIG. 2, the doming will change direction cyclically with a cycle length of 15 mm: the shadow mask will dome toward the left between the points A4*a* and A5*a*, toward the right between the points A5*a* and A4*b*, and so on. Instead of one large convex dome as in FIG. 1, there will be a series of smaller convex and concave domes. Apertures 3 will therefore be displaced only slightly from their ideal positions, and the problem of color misregistration will be substantially eliminated.

When localized doming does not occur, the undulating profile of the front surface 21 does not affect the performance of the shadow mask 2, because the minimum aperture plane 33 is at the desired position relative to the faceplate.

Next the preferred ranges of the dimensions for various parts of the shadow mask 2 will be described. Referring again to line 3—3 in FIG. 2, the spacing between adjacent ribs (e.g. the distance from A1*a* to A1*b*) is preferably from twenty to three hundred times the original thickness of the steel sheet 7, that is, twenty to three hundred times the thickness of the ribs 23. The reason for the lower limit is that if this spacing is too small, the local thickness variations will be ignored: the shadow mask 2 will behave like a smooth plate with a uniform thickness equal to the average local thickness.

The length up to which local irregularities are ignored in thermal expansion is a physical constant known as the characteristic length. According to a theoretical study, the square of the characteristic length of a steel shadow mask is approximately $0.37 \times R \times T$, where R is the radius of curvature of the shadow mask and T is its thickness. The coefficient 0.37 should be treated as approximate because it depends on the size and shape of the apertures 3.

Before the shadow mask 2 is processed to create local thickness variations, its radius of curvature is preferably 1000 to 4000 mm, and its thickness is preferably from 0.15 to 0.30 mm. The characteristic length is then 7 to 20 mm. The removal of material to create local thickness variations tends to reduce the characteristic length, but having too many closely-spaced ribs would increase the manufacturing cost. From considerations such as these, a preferable lower rib-spacing limit of at least twenty times the original thickness of the steel sheet 7 can be inferred.

The reason for the upper limit is that the neutral plane 25 must curve both outward at the ribs and inward in the vicinity of the center lines 24 of the troughs. If the neutral plane 25 fails to curve inward, or does so only over very short intervals, doming will occur only in the outward direction. If the rib spacing is more than three hundred times the original thickness of the steel sheet 7, the effect of the thickness variations becomes negligible.

The width of the ribs (the interval in which the original thickness is left intact, e.g. the interval from A1*a* to A2*a* in FIG. 2) must be adequate to provide structural strength. This interval can be enlarged to provide greater concave curvature in the trough areas. This ensures adequate trough areas even if there are some errors in forming the undulations.

The reason for the zig-zag shape of the ribs is so that in a cross-section in any direction, the front surface 21 of the shadow mask 2 will present alternating convex and concave areas. Sections not parallel to the line 3—3 will not have the same profile as the section through 3—3, so if the 3—3 profile is optimized, profiles in other directions may not be optimum. This is not a serious problem, however, because the mechanical radius of curvature that determines the direction of doming is the weighted average of the radius of curvature in all directions, the weighting being with respect to the stiffness of the material in different directions. Stiffness can be defined as the load that would have to be applied to bend a narrow strip of the material by a fixed amount. Because of the columnar disposition and slot-like shape of the apertures 3, the stiffness of the shadow mask 2 is greatest in the Y direction. Therefore, if the profile of the neutral plane 25 is optimized in the Y direction, the expected doming-reduction effect will be obtained despite departures from optimum profile in other directions.

Figure 6:
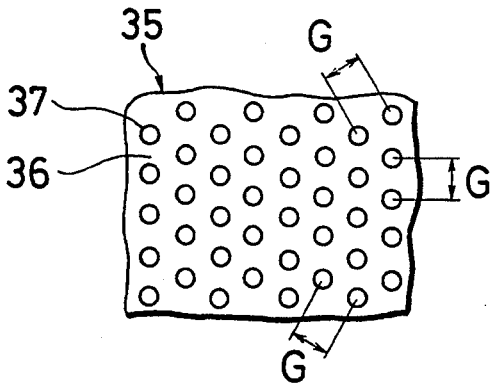
FIG. 6 is an enlarged view of part of a novel shadow mask with round-hole apertures.
Figure 7:
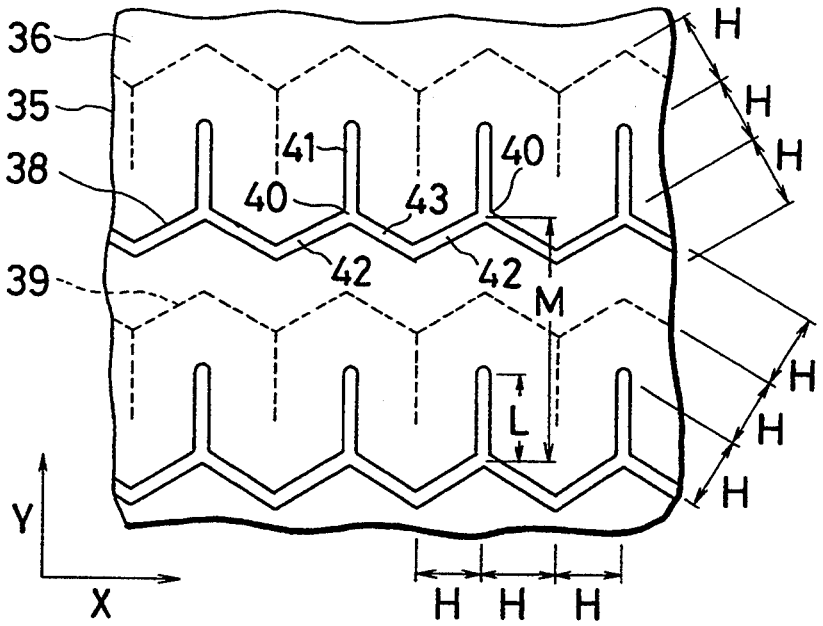
FIG. 7 is a plan view allowing a larger portion of the shadow mask in FIG. 6.

The invention can be applied not only to slotted shadow masks but also to round-hole shadow masks. FIGS. 6 and 7 next show a novel shadow mask of-the round-hole type.

FIG. 6 shows this novel shadow mask before variations in local thickness have been created. The shadow mask 35 is made from a steel sheet 36 having the same thickness (0.25 mm) as the steel sheet 7 in FIG. 2. The apertures 37 are round holes disposed in an equilateral triangular pattern, each aperture 37 being spaced at a distance of 0.6 mm (shown by the letter G) from its nearest neighbors. The apertures 37 are tapered in the manner already described, with the minimum aperture plane located close to the back surface of the shadow mask 35. The rigidity of this shadow mask 35 is substantially the same in all directions.

Referring to FIG. 7, after being given the desired overall curvature, the steel sheet 36 is further processed to create local thickness variations comprising ribs 38 separated by troughs. As before, the original thickness is left in the ribs 38, and the minimum thickness occurs at center lines 39 of the troughs. Because the rigidity of the shadow mask 35 is the same in all directions, it is desirable for the thickness profile to be the same or at least similar in all directions. The zig-zag pattern of the ribs in FIG. 7 is therefore more complex than the pattern in FIG. 2.

In FIG. 7 each rib 38 has a plurality of vertices 40 aligned in a baseline direction, this being the horizontal or X direction in the drawing. The baseline direction is the same for all ribs. Each rib 38 has first linear extensions 41 extending from the vertices 40 in a first direction (the upward or Y direction in the drawing) at an angle, e.g., perpendicular to the base line direction. This first direction is also the same direction (up in the drawing) for all the ribs 38. Each rib 38 also has second linear extensions 42 extending from the vertices 40 in a second direction at an angle of $\alpha°$ ($90<\alpha<180$) to the first direction, and third linear extensions 43 extending from the vertices 40 in a third direction at an angle of $\beta°$ ($90<\beta<180$) to the first direction and at an angle $(360-\alpha-\beta)°$ to the second direction. The second linear extensions 42 and third linear extensions 43 from adjacent vertices 40 have such lengths just adequate to meet one another, thereby forming a zig-zag pattern. The length of each of the first linear extensions 41 is L1.

The center lines 39 of the troughs have a complementary configuration, comprising vertices with linear extensions that extend in the downward direction in the drawing and in two other directions at angles to the downward direction. The ribs 38 are interleaved with the center lines 39 of the troughs.

In the illustrate embodiment, $\alpha=\beta=120$, and the first, second and third linear extensions 41, 42, and 43 all have the same length L, and this length is just long enough for the second linear extensions 42 and third linear extensions 43 from adjacent vertices 40 to meet one another. The spacing M between ribs 38 in the Y direction is three times the length L. For example, L is 14 mm and M is 42 mm.

The linear extensions extending from the vertices are at angles of 120° to one another. The distances between the ribs 38 and the center lines 39 in the X direction are L times one-half the square root of three; this distance is shown as 12 mm (represented by the letter H) in the drawing. The distances between the ribs 38 and the center lines 39 of the troughs are also 12 mm in two other directions at angles of 120° to the X direction as indicated in the drawing, and the rib-to-center-line distance does not differ greatly from 12 mm in any direction.

A cross section through the shadow mask 35 in FIG. 7 shows an undulating profile like the cross section in FIG. 2, with a concave back surface and an alternately convex and concave front surface. In some directions the profile is substantially identical to that in FIG. 2. In other directions the profile, although not identical, is still generally similar to that in FIG. 2. Therefore, with an appropriate spacing M between ribs 38, the shadow mask 35 in FIG. 7 effectively prevents localized doming.

Figure 8:
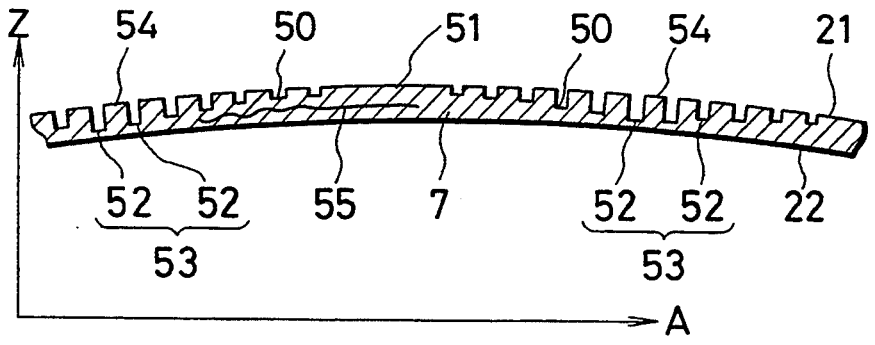
FIG. 8 is a sectional view of another novel shadow mask.

Instead of creating a smoothly undulating profile as in FIG. 2, it is possible to achieve the same effect with a grooved profile. Referring to FIG. 8, the steel sheet 7 is processed to impart the desired curvature to the front surface 21 and back surface 22, then closely-spaced grooves 50 are cut into the front surface 21. Ribs 51 are left free of grooves. The grooves 50 vary gradually in depth, grooves of the least depth being disposed near the ribs 51, and grooves of the greatest depth 52 being disposed in center areas 53 near the center lines of troughs between the ribs 51. Local thickness in this case refers to the distance from the bottom of the grooves to the back surface 22 of the shadow mask. The areas 54 remaining between the grooves 50 have the original thickness of the steel sheet 7.

The neutral plane 55 shows small-scale variations due to the difference between the grooves 50 and intervening areas 54, but if the grooves 50 are spaced more closely than the characteristic length described above, these small-scale variations do not affect localized doming. Localized doming is controlled by the larger-scale configuration of the neutral plane 55, which is determined by the depth of the grooves 50 and the proportion of the areas where the grooves 50 are provided, and has the same undulating profile as in FIG. 2. The ribs 51 can have either the simple zig-zag pattern shown in FIG. 2 or the more complex zig-zag pattern shown in FIG. 7. FIG. 8 produces the same anti-doming effect as FIGS. 2 and 7.

Figure 9:
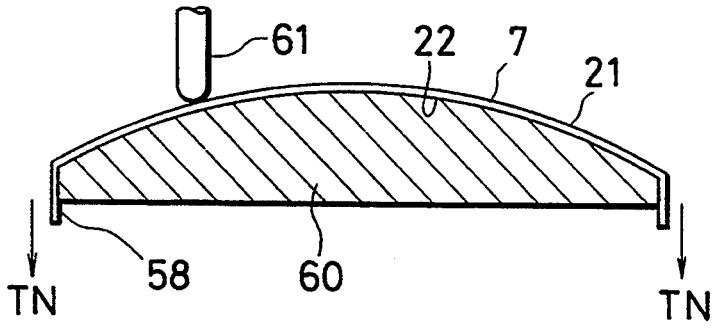
FIG. 9 is a sectional view illustrating a step in a novel shadow-mask manufacturing process.

Next a preferred method of manufacturing the invented shadow mask will be described, with reference to FIG. 9.

The first step in the manufacturing process is to etch a steel sheet 7 to form apertures. The etching is carried out from both the front and back surfaces of the steel sheet 7, but is controlled so that the steel sheet 7 is etched more deeply from the front surface 21. As a result, the apertures formed have sidewalls that taper toward both sides of the metal sheet, but the tapers meet in a minimum aperture plane that is closer to the back surface 22 than to the front surface 21, as described above.

In the next step, the steel sheet 7 is press-formed to impart a curvature such that the front surface 21 is convex and the back surface 22 is concave. A skirt 58 is also formed at edges of the metal sheet in this step.

Etching and press-forming are well known, so the preceding steps are not explicitly illustrated in FIG. 8; only the resulting shape is shown.

In the next step the steel sheet 7 is placed on an identically-curved supporting block 60, the back surface 22 of the steel sheet 7 being in contact with a supporting block 60. If necessary, tight contact can be maintained by tension TN (FIG. 5) on the skirt 58.

In the next step, the front surface 21 of the steel sheet 7 is machined to create local thickness variations. The variations have the rib-and-trough pattern shown in FIG. 2 or FIG. 7, for example, and can have either a smooth profile as shown in FIG. 2 or a grooved profile as shown in FIG. 8. This step can be carried out by a milling machine with a cutting tool 61. Since the steel sheet 7 is in contact with the supporting block 60, the milling can be controlled by measuring and controlling the distance of the cutting tool 61 from the supporting block 60.

The reason for performing these steps in the above order is as follows. The etching step is carried out before the press-forming step because it is difficult to etch uniform apertures in a curved metal sheet. It would be particularly difficult to control the depth of the minimum aperture plane. The press-forming step is carried out before the milling step because if local thickness variations were created before press-forming, the steel sheet would respond unevenly to pressure, leading to misregistration problems. The reason for the supporting block 60 is that it would be impossible to machine a thin steel sheet accurately without such support.

If the sharp zig-zag pattern in FIG. 2 is followed precisely, milling problems such as scoring may occur. These problems can be avoided by creating a more rounded zig-zag pattern. For example, the ribs and the center lines of the troughs can have a sine-wave configuration.

Another milling problem that may occur is the formation of burrs at the edges of the apertures. Such burrs can cause incorrect color rendition, and if they become detached during use, the resulting loose fragments of metal may degrade the performance of the cathode-ray tube. This burring problem can be avoided by filling the apertures with a hard organic substance such as lacquer before milling. After the milling step, the lacquer can be dissolved with a solvent, or can be removed by heating.

As will be apparent to those skilled in the art, the shadow masks described above can be modified in various ways without departing from the spirit and scope of the invention as set forth in the following claims.

What is claimed is:

1. A shadow mask for a color cathode-ray tube, comprising:

a metal sheet with apertures for passage of electron beams, wherein said metal sheet has a front surface and a back surface;

said back surface has a concave curvature;

said front surface generally follows the curvature of said back surface but has an undulating profile comprising ribs and troughs, said troughs separating said ribs and having center lines;

said metal sheet has a local thickness that is maximum at said ribs and gradually becomes thinner toward said center lines of said troughs;

said ribs have a zig-zag configuration; and said center lines of said troughs have a zig-zag configuration.

2. The shadow mask of claim 1, wherein said metal sheet is a steel sheet.

3. The shadow mask of claim 1, wherein said apertures have tapered sidewalls.

4. The shadow mask of claim 1, wherein said apertures have a minimum aperture plane and said minimum aperture plane is closer to said back surface than to said front surface.

5. The shadow mask of claim 1, wherein said ribs have a mutual spacing which is at least twenty times said maximum local thickness and which is at most three hundred times said maximum local thickness.

6. The shadow mask of claim 1, wherein said apertures are elongated slots.

7. The shadow mask of claim 6, wherein said apertures are aligned in columns in a first direction.

8. The shadow mask of claim 7, wherein said ribs are aligned parallel to one another and run generally in a second direction perpendicular to said first direction.

9. The shadow mask of claim 8, wherein said ribs have a regular mutual spacing in said first direction and zig-zag with an amplitude equal to said mutual spacing in said first direction.

10. The shadow mask of claim 9, wherein said ribs zig-zag with a repeating length equal to said mutual spacing.

11. The shadow mask of claim 1, wherein said apertures are round holes.

12. The shadow mask of claim 11, wherein said apertures are disposed in an equilateral triangular pattern.

13. The shadow mask of claim 12, wherein each of said ribs comprises:

a plurality of equally-spaced, collinear vertices disposed parallel to a certain baseline direction, said baseline direction being identical for all of said ribs;

first linear extensions, of a first length, extending from said vertices in a first direction at a first angle to said baseline direction;

second linear extensions, of a second length, extending from said vertices in a second direction at a second angle to said first direction; and third linear extensions, of a third length, extending from said vertices in a third direction at a third angle to said first direction and at a fourth angle to said second direction, with said fourth angle being equal to 360° minus said second angle minus said third angle, wherein said second linear extensions and said third linear extensions from adjacent vertices meet one another.

14. The shadow mask of claim 13, wherein said second and third lengths are adequate for said second linear extensions and said third linear extensions from adjacent vertices to meet one another.

15. The shadow mask of claim 13, wherein said first linear extensions, said second linear extensions, and said third linear extensions have identical length, said second, third and fourth angles are 120°, and said first angle is 90°.

16. The shadow mask of claim 15, wherein said first direction is identical for all of said ribs, and said ribs are separated by a mutual spacing in said first direction equal to three times the length of said first linear extensions, said second linear extensions, and said third linear extensions.

17. The shadow mask of claim 1, wherein each of said troughs comprises a plurality of grooves separated by areas equal in thickness to said ribs.

18. The shadow mask of claim 17, wherein said grooves vary gradually in depth, grooves of the least depth being disposed near said ribs and grooves of the greatest depth being disposed near said center lines of said troughs.

19. A shadow mask for a color cathode-ray tube, comprising:

a metal sheet with apertures for passage of electron beams, wherein said metal sheet has a front surface and a back surface;

said back surface has a concave curvature;

said front surface generally follows the curvature of said back surface but has an undulating profile comprising ribs and troughs, said troughs separating said ribs and having center lines;

said metal sheet has a local thickness that is maximum at said ribs and gradually becomes thinner toward said center lines of said troughs, wherein said ribs have a mutual spacing which is at least twenty times said maximum local thickness and which is at most three hundred times said maximum local thickness.

20. The shadow mask of claim 19, wherein said metal sheet is a steel sheet.

21. The shadow mask of claim 19, wherein said apertures have tapered sidewalls.

22. The shadow mask of claim 19, wherein said apertures have a minimum aperture plane and said minimum aperture plane is closer to said back surface than to said front surface.

23. The shadow mask of claim 19, wherein said apertures are elongated slots.

24. The shadow mask of claim 23, wherein said apertures are aligned in columns in a first direction.

25. The shadow mask of claim 24, wherein said ribs are aligned parallel to one another and run generally in a second direction perpendicular to said first direction.

26. The shadow mask of claim 25, wherein said ribs have a regular mutual spacing in said first direction and zig-zag with an amplitude equal to said mutual spacing in said first direction.

27. The shadow mask of claim 26, wherein said ribs zig-zag with a repeating length equal to said mutual spacing.

28. The shadow mask of claim 19, wherein said apertures are round holes.

29. The shadow mask of claim 28, wherein said apertures are disposed in an equilateral triangular pattern.

30. The shadow mask of claim 29, wherein each of said ribs comprises:

a plurality of equally-spaced, collinear vertices disposed parallel to a certain baseline direction, said baseline direction being identical for all of said ribs;

first linear extensions, of a first length, extending from said vertices in a first direction at a first angle to said baseline direction;

second linear extensions, of a second length, extending from said vertices in a second direction at a second angle to said first direction; and third linear extensions, of a third length, extending from said vertices in a third direction at a third angle to said first direction and at a fourth angle to said second direction, with said fourth angle being equal to 360° minus said second angle minus said third angle, wherein said second linear extensions and said third linear extensions from adjacent vertices meet one another.

31. The shadow mask of claim 30, wherein said second and third lengths are adequate for said second linear extensions and said third linear extension from adjacent vertices to meet one another.

32. The shadow mask of claim 30, wherein said first linear extensions, said second linear extensions, and said third linear extensions have identical length, said second, third and fourth angles are 120°,and said first angle is 90°.

33. The shadow mask of claim 32, wherein said first direction is identical for all of said ribs, and said ribs are separated by a mutual spacing in said first direction equal to three times the length of said first linear extensions, said second linear extensions, and said third linear extensions.

34. The shadow mask of claim 19, wherein each of said troughs comprises a plurality of grooves separated by areas equal in thickness to said ribs.

35. The shadow mask of claim 34, wherein said grooves vary gradually in depth, grooves of the least depth being disposed near said ribs, and grooves of the greatest depth being disposed near said center lines of said troughs.

* * * * *